US010047766B2

(12) United States Patent
Mistry

(10) Patent No.: US 10,047,766 B2
(45) Date of Patent: Aug. 14, 2018

(54) AIR COMPRESSOR SYSTEM

(71) Applicant: Ingersoll-Rand Company, Davidson, NC (US)

(72) Inventor: Ritesh Mistry, Gujarat (IN)

(73) Assignee: Ingersoll-Rand Company, Davidson, NC (US)

( * ) Notice: Subject to any disclaimer, the term of this patent is extended or adjusted under 35 U.S.C. 154(b) by 453 days.

(21) Appl. No.: 14/710,271

(22) Filed: May 12, 2015

(65) Prior Publication Data

US 2015/0330409 A1 Nov. 19, 2015

(30) Foreign Application Priority Data

May 14, 2014 (IN) ..... 536/KOL/2014

(51) Int. Cl.

| | |
|---|---|
| ***F04D 25/16*** | (2006.01) |
| ***F04D 29/58*** | (2006.01) |
| ***F01C 21/00*** | (2006.01) |
| ***F04B 35/06*** | (2006.01) |
| ***F04B 39/06*** | (2006.01) |
| ***F04C 29/04*** | (2006.01) |
| ***F04B 39/14*** | (2006.01) |

(Continued)

(52) U.S. Cl.

CPC ..... *F04D 29/5833* (2013.01); *F01C 21/007* (2013.01); *F04B 35/06* (2013.01); *F04B 39/06* (2013.01); *F04B 39/14* (2013.01); *F04C 29/04* (2013.01); *F04D 29/5826* (2013.01); *F04C 2230/60* (2013.01); *F04C 2230/604* (2013.01); *F04D 17/12* (2013.01); *F04D 25/02* (2013.01); *F04D 25/163* (2013.01); *F04D 29/601* (2013.01); *F05D 2260/211* (2013.01)

(58) Field of Classification Search

CPC ... F04D 25/163; F04D 29/582; F04D 29/5826

See application file for complete search history.

(56) References Cited

U.S. PATENT DOCUMENTS

| | | | | |
|---|---|---|---|---|
| 3,644,054 A * | 2/1972 | Pilarczyk | ..... | F04D 29/582 165/47 |
| 3,748,065 A * | 7/1973 | Pilarczyk | ..... | F04D 29/582 415/122.1 |

(Continued)

FOREIGN PATENT DOCUMENTS

| | | |
|---|---|---|
| EP | 0587157 A2 | 3/1994 |
| EP | 2336654 A2 | 6/2011 |
| WO | 2008039733 A2 | 4/2008 |

OTHER PUBLICATIONS

European Search Report and Written Opinion, EP15167591, dated Sep. 11, 2015, 7 pages.

*Primary Examiner* — Patrick Hamo

(74) *Attorney, Agent, or Firm* — Taft Stettinius & Hollister LLP

(57) ABSTRACT

A compressor system is disclosed that includes a base structure having a first portion engageable with a support surface and a second portion cantilevered from the first portion. A compressor can be positioned on the first portion of the base structure and an intercooler in fluid communication with the compressor is supported by the second cantilevered portion. At least one attachment mount with a hook member connected to the intercooler is slidingly engageable with the second portion of the base structure.

21 Claims, 4 Drawing Sheets

(51) Int. Cl.

| | |
|---|---|
| *F04D 29/60* | (2006.01) |
| *F04D 17/12* | (2006.01) |
| *F04D 25/02* | (2006.01) |

(56) References Cited

U.S. PATENT DOCUMENTS

| | | | | |
|---|---|---|---|---|
| 3,835,918 | A * | 9/1974 | Pilarczyk | F04D 29/582 165/119 |
| 4,130,376 | A | 12/1978 | Dietsche | |
| 5,795,136 | A | 8/1998 | Olsaker et al. | |
| 6,991,440 | B2 | 1/2006 | Achtelik et al. | |
| 7,708,538 | B2 | 5/2010 | Kawabata et al. | |
| 7,819,634 | B2 | 10/2010 | Kolodziej et al. | |
| 7,832,992 | B2 | 11/2010 | Kolodziej et al. | |
| 8,376,718 | B2 | 2/2013 | Baker et al. | |
| 8,647,076 | B2 | 2/2014 | Baker et al. | |
| 8,740,251 | B2 * | 6/2014 | Batson | B64F 1/28 137/355.16 |
| 2003/0059299 | A1 * | 3/2003 | Miura | F04D 25/163 415/179 |
| 2013/0078118 | A1 | 3/2013 | Maier et al. | |
| 2013/0251556 | A1 | 9/2013 | DePaz et al. | |
| 2014/0017110 | A1 | 1/2014 | Zemliak | |
| 2014/0072467 | A1 | 3/2014 | Wang et al. | |

* cited by examiner

AIR COMPRESSOR SYSTEM

TECHNICAL FIELD

The present invention generally relates to industrial air compressor systems and more particularly, but not exclusively, to assembly and connection of one or more intercoolers with the compressor systems.

BACKGROUND

Large industrial compressor systems typically have complex design and assembly procedures, and are difficult to move due to the large size and weight. Reducing system complexity can reduce costs related to manufacturing and assembly as well as to increase durability of the system. Some existing systems have various shortcomings relative to certain applications. Accordingly, there remains a need for further contributions in this area of technology.

SUMMARY

One embodiment of the present invention is a unique compressor system. Other embodiments include apparatuses, systems, devices, hardware, methods, and combinations for compressor systems with an intercoler suspended from a base support. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
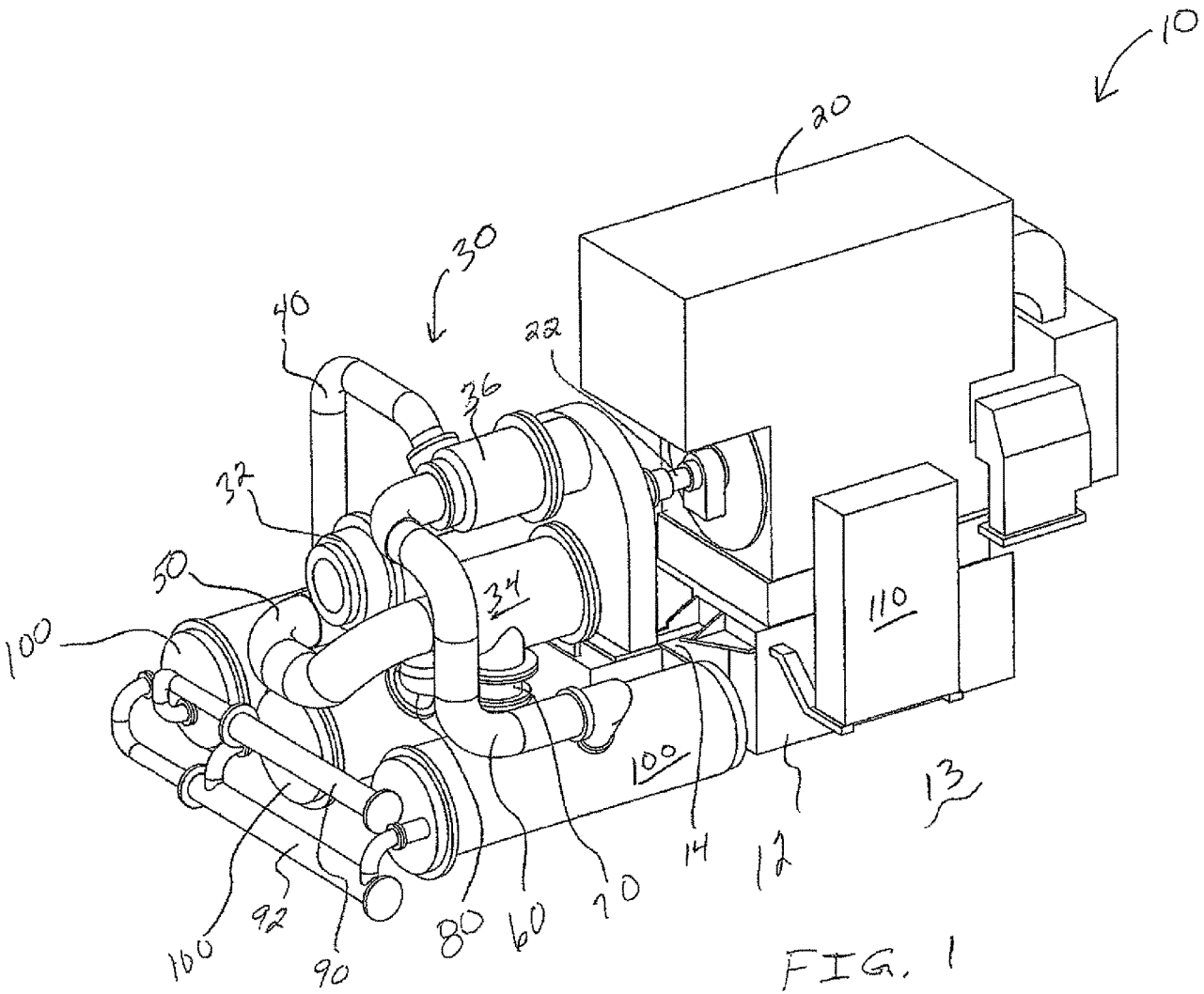
FIG. 1 is a perspective view of a compressor system according to one embodiment of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Industrial compressor systems that use external fluid to fluid heat exchangers such as intercoolers are heavy weight packages. Heat exchangers as defined herein can be of any type commonly utilized in industrial applications. It should be noted that terms such as intercooler, cooler, inter-stage cooler, aftercooler or the like can be interchanged or substituted and still fall within the broad definition of a heat exchanger as defined by the present disclosure. Present compressor systems include intercoolers and a main base to support airend components and a motor with integral oil reservoir. Typically because each of the size and weight of industrial components each of the components are transported separately and assembled on site.

The compressor system packaging concept of the present disclosure eliminates the need for a large base structure and enables the transportation of the package in a single unit so as to avoid site assembly work during installation. This concept is scalable and can be applied to the entire range of compressors.

An aspect of assembling heavy weight intercoolers is disclosed in the present application. The intercoolers can be hung from a central base structure and then optionally clamped by bolted joints. The intercoolers can include an attachment such as a hanger bracket that enables mounting of the intercoolers to the base structure. The structural design of the intercooler shell and hanger bracket allows for free thermal expansion of cooler shell during all system operating conditions and also allows lifting of heavy coolers along with the base structure without permanent deforming or damaging the cooler shell.

An intercooler of the present application may promote a modular design concept; may promote standardization of structures and components across an entire range and size of centrifugal compressors with external coolers; may reduce overall footprint size; may promotes cost reduction and component quality improvement due to modular design; may Isolates thermal stress and deflection of coolers from base structure; and/or may ease assembly and serviceability of coolers and other subsystems.

Referring now to FIG. 1, a compressor system 10 is shown therein. The compressor system included a primary motive source 30 such as an electric motor, an internal combustion engine or a fluid-driven turbine and the like. The compressor 30 can include multi-stage compression and in the exemplary embodiment includes a first stage compressor 32, a second stage compressor 34, and a third stage compressor 36. In other embodiments a different number of stages may be employed. The primary motive source 20 is operable for driving a compressor 30 via a drive shaft 22 to compress fluids such as air or the like. A structural base 12 is configured to support at least portions of the compressor system 10 on a support surface 13 such as a floor or ground and the like. One or more cantilevered extensions or arms 14 can extend from the base 12 and is configured to hold portions of the compressor system 10 suspended above the support surface 13 as will be described in more detail below. Portions of the compressed air discharged from the compressor 30 can be transported through more one or more conduits 40, 50, 60, 70 and 80 to one or more intercoolers 100 and/or to another compressor stage. An inlet fluid manifold 90 and an outlet fluid manifold 92 can be fluidly connected to the intercoolers 100 to provide cooling fluid such as water or other liquid coolant to cool the compressed air after discharge from one or more of the compressor stages of the compressor 30. The compressor system 10 can also include a controller 110 operable for controlling the primary motive power source and various valving and fluid control mechanisms (not shown) between the compressor 30 and intercoolers 100.

Figure 2:
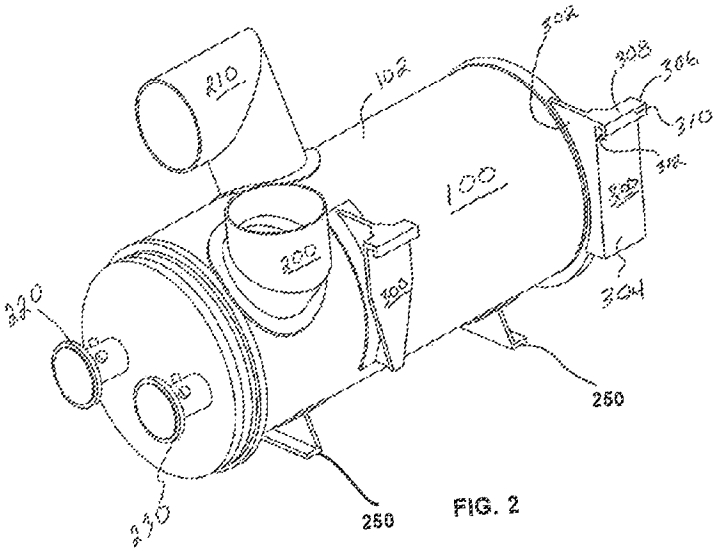
FIG. 2 is a perspective view of an intercooler with unique attachment brackets.

Referring now to FIG. 2, each intercooler 100 can include an air inlet port 200 and an air outlet port 210 to transport relatively hot air into the intercooler and transport relatively cooler air out of the intercooler 100. The intercooler 100 can also include a cooling fluid inlet port 220 and a cooling fluid outlet port 230 to transport the cooling medium such as water or the like into and out of the intercooler 100. One or more freestanding support stands 250 can be connected to the intercooler 100 so that the intercooler 100 can be placed on a support surface while manufacturing, attaching or otherwise assembling the intercooler 100 with the compressor system 10. It should be noted that during operation the support stands 250 do not contact the support base 12 or support surface 13.

One or more attachment mounts or hanging brackets 300 can be attached to an outershell 102 of the intercooler 100. The hanging brackets 300 can be attached to the outershell 102 by any means desired, however, in an illustrative embodiment the hanging brackets can be welded to the outer shell 102. Other attachment means can include the use of threaded fasteners and/or locking connections such as dovetail joints, pressfit configurations and other mechanical fastening means as would be known by those skilled in the art. Each hanging bracket 300 can include an attachment portion 302 that can conform with a portion of the surface of the outer shell 102. In the illustrative embodiment the outer shell 102 is substantially round and forms a cylinder shape wherein the attachment portion 302 is formed with a complimentary surface to that of the outer shell 102. It should be understood that the illustrative shape is but one example and that other forms and shapes are contemplated herein. Each hanging bracket 300 can include a substantially flat vertical face 304 that transitions into a hook portion 306 having a top portion 308 that extends from the vertical face 304 to a front ledge 310. The front ledge 310 extends downward in substantially parallel orientation as the flat vertical face 304. It should be understood that the terms vertical and parallel do not need to be exact and that various differing angles and curved portions may be employed in certain embodiments. A space or groove 312 is formed between the front ledge 310 and the vertical face 304 so as to provide means for hanging the intercooler 100 onto a portion of the base 12 of the compressor system 10 as will be described in detail below.

Figure 3:
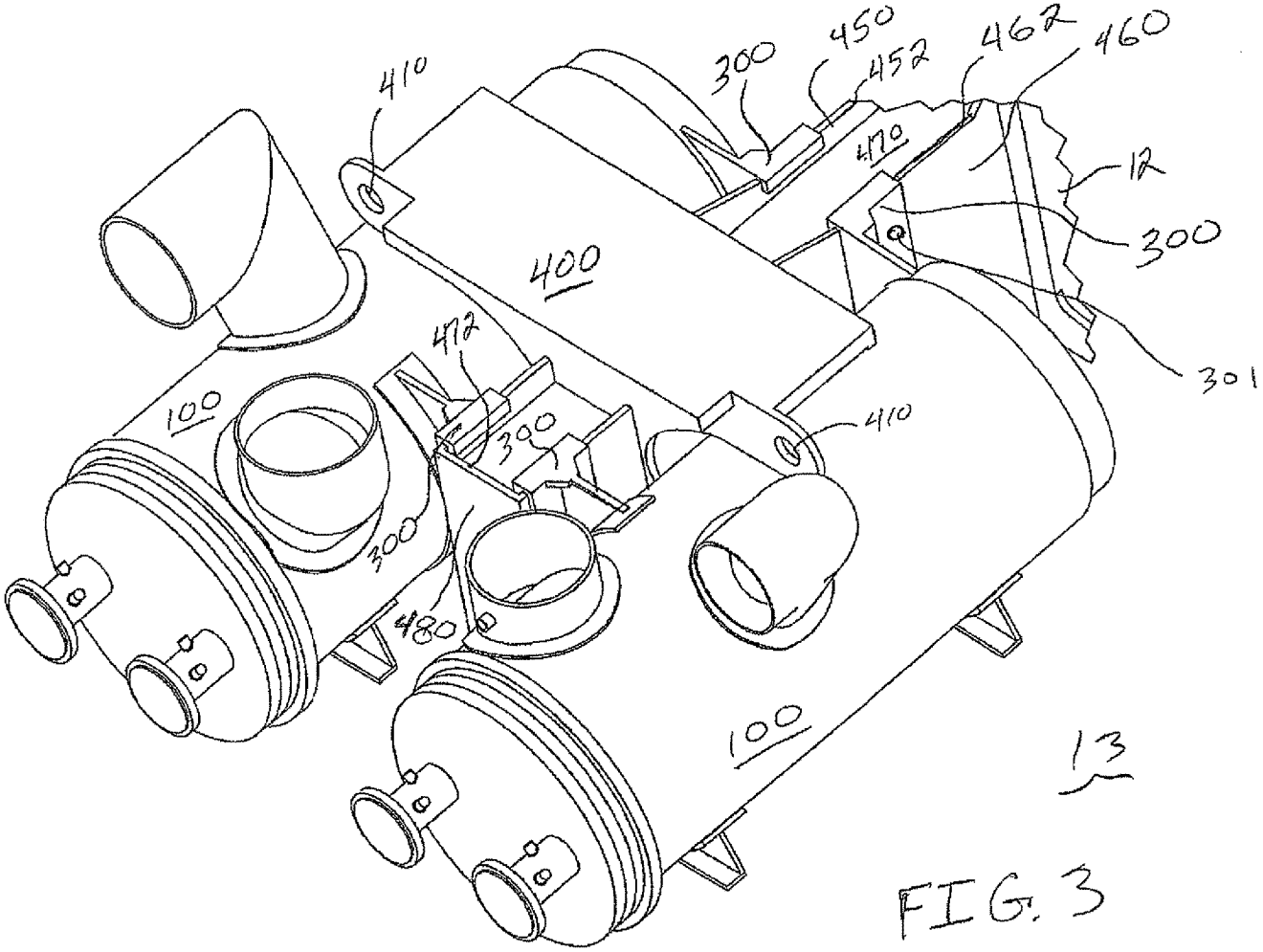
FIG. 3 is a perspective view of a pair of intercoolers and a supporting mount assembly.

Referring now to FIG. 3, a pair of intercooler heat exchangers 100 are shown coupled to an extension from the base 12. A portion of the compressor system 10 can be mounted onto the base 12 that is engaged with a support surface such as a platform or the ground. The base 12 can include a cantilevered portion such as an arm that can be partially viewed in FIG. 1, but more clearly seen in FIG. 3. The cantilevered arm 14 can include a cross member 400 that extends between the pair of intercoolers 100. The cross member 400 can include one or more eyelets 410 configured to permit an attachment mechanism such as a hoist, chain, rope, cable or other lifting member (not shown) to attach thereto or lift and help position the entire compressor system 10. The cantilevered arm 14 can include first second walls 450, 460 that are substantially parallel to one another and oriented in a substantially vertical direction. As explained above the terms parallel and vertical are not meant to rigidly define and variation to the extent that the system can be assembled and operated according to the principles herein is contemplated. The walls 450, 460 extend in cantilever fashion away from the base 12 above the support surface 13 under the base 12. A top wall 470 can extend between the first wall 450 and second wall 460 to define a width of the cantilevered arm 14. Both the first wall 450 and the second wall 460 can include a top portion 452, 462, respectively for the hanging brackets 300 to slidingly engage over the top thereof. The hanging brackets 300 permit each intercooler 100 to be supported by the cantilevered arm 14 above a support surface 13 and also permits the intercoolers 300 assembly to slide along the top portions 452, 462 of the cantilevered arm 14 in response to forces such as thermal expansion of various components and/or to properly position the intercooler 100 for assembly with the compressor system 10. In one form one or more of the hanging brackets 300 can be releasably locked to the cantilevered arm via a threaded fastener 301 or the like after installation. The hanging brackets 300 permit the intercooler to expand and contract under variable thermal loads when one or more brackets are bolted or when all are free from mechanical fastening. A forward wall 480 connected to the side walls 450 and 460 provides structural stability and an abutment portion 472 to prevent the hanging brackets 300 from inadvertently sliding past the forward edge of the cantilevered arm 14.

Figure 4:
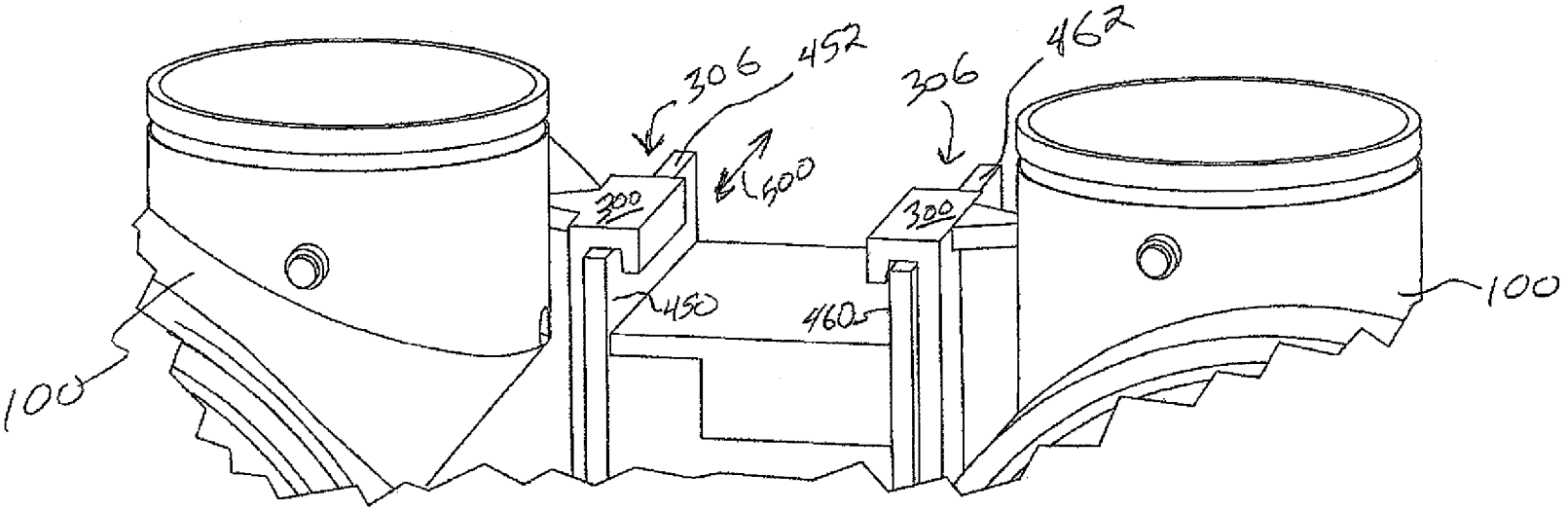
FIG. 4 is an enlarged view of a portion of the attachment brackets of the intercooler and mount assemblies of FIG. 3.

Referring now to FIG. 4, an enlarged perspective view of a portion of the intercooler assembly is shown to provide a close up view of the attachment portion of the hanging brackets 300. The hook portions 306 of the hanging brackets 300 can be hung over the top edge of the top portion 452 of the first wall 450 and the top portion 462 of the second wall 460. The hook portion 306 of each of the hanger brackets 300 can slide back and forth along the direction illustrated by the double arrow line 500 so as to limit binding caused by from thermal expansion as well as to ease the assembly procedures and improve structural integrity during operation of the compressor system 10. It should be understood that while the cantilevered arm 14 is illustrated as having an intercooler 300 attached to either side, that in alternate embodiments only one intercooler 300 may be attached to a cantilever arm 14.

In operation the compressor system is configured to provide compressed air at a desired temperature and pressure to external systems. The compressor systems can be used in any industrial application including but not limited to automobile manufacturing, textile manufacturing, process industries, refineries, power plants, mining, material handling, etc. The controller permits user input to define parameters such as pressure, temperature and mass flow rate. The controller will send command signals to the motor to rotate at a desired operating speed in order to drive the one or more compressors and control various valving to control airflow rate and coolant flow rate. In the illustrative example, the compressor system includes a three-stage centrifugal compressor system, however, the system can operate with other types of compressors and/or with more or less stages of compressors. One or more intercoolers can be fluidly coupled to each compressor stage such that after air is compressed through the first stage the air can be transported through a first intercooler and can be cooled to a desired temperature via a heat transfer mechanism such as conduction and convection in tube type heat exchangers. The compressed air can then be transported into a second stage compressor where the air further compressed and necessarily heated to a higher temperature through a thermodynamic process. The second stage compressed air can then be routed through a second intercooler to cool the air to desired temperature while remaining at or close to the compressor outlet pressure of the second stage compressor. The cooled compressed air exiting from the second intercooler can then be transported to a third stage compressor where it is compressed to a final desired pressure and then subsequently routed to a third stage intercooler to bring the temperature of the final discharged air pressure to the desired temperature for delivery to a final subsystem. In one form the compressors can be centrifugal compressors, however, other forms of compression can include axial flow compressors, piston compressors or other positive displacement compressors can be used under the teachings of the present disclosure. The intercoolers are designed and assembled in such a manner as to permit thermal expansion relative to the other components of the compressor system including the base support and the cantilevered portions extending from the base support. In this manner the intercoolers can remain structurally sound and minimize potential mechanical failure such as cracks generated by loads caused by mechanical constraints that limit material expansion during conditions of high temperature gradients across the system. Material selection for the intercoolers, the base support structure and other components can include various forms of metal, composites or metal alloys as desired. Metals can include but are not limited to aluminum, steel, iron, and/or super alloys. The metal material may further be formed from cast, wrought, or sheet configuration.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A compressor system comprising:

a base structure having a first portion engageable with a support surface and a second portion cantilevered from the first portion;

a compressor positioned on the first portion of the base structure;

an intercooler in fluid communication with the compressor;

at least one attachment mount with a hook member connected to the intercooler;

wherein the hook member is slidingly engageable with the second portion of the base structure.

2. The compressor system of claim 1, wherein the at least one attachment mount supports the intercooler above the support surface.

3. The compressor system of claim 1, wherein the at least one mount permits sliding movement of the intercooler along the second portion of the base portion.

4. The compressor system of claim 1, wherein the at least one attachment mount is connected to the intercooler through at least one of a weld, mechanical fastener, and mechanical interference joint.

5. The compressor system of claim 1, wherein the at least one attachment mount and an outer shell of the intercooler are formed of a metal material.

6. The compressor system of claim 5, wherein the metal material can be selected from one or more of a steel, aluminum, an iron a super alloy and mixtures thereof.

7. The compressor system of claim 1, wherein the intercooler is one of an air to air and an air to liquid heat exchanger.

8. The compressor system of claim 7, wherein the liquid includes water, ethylene glycol and/or propylene glycol.

9. The compressor system of claim 1, further comprising:

a motive source to operate the compressor.

10. The compressor system of claim 9, wherein the motive source includes one or more of an electric motor, internal combustion engine and a fluid driven turbine.

11. An apparatus comprising:

a support base for supporting portions of a compressor system;

at least one cantilevered arm extending from the base;

at least one intercooler having a bracket hanger configured to slidingly engage with a portion of the at least one cantilevered arm and support the at least one intercooler therefrom; and wherein the at least one intercooler is fluidly connected to the compressor system and is slidingly movable with respect to the at least one cantilevered arm in an installed configuration.

12. The apparatus of claim 11, wherein the compressor system includes multi-stage centrifugal compressors driven by a motive source.

13. The apparatus of claim 12, wherein the at least one intercooler includes an intercooler fluidly connected to an outlet of each of the multi-stage compressors.

14. The apparatus of claim 11, wherein the at least one cantilevered arm includes first and second support walls to slidingly support a pair of intercoolers on opposing sides thereof.

15. The apparatus of claim 11, wherein each intercooler includes at least one bracket attached thereto; and wherein the bracket includes a hook portion engageable with the cantilevered arm to hang the intercooler in a suspended position above a support surface.

16. The apparatus of claim 15, wherein the at least one bracket is welded to an outer surface of the intercooler.

17. A method comprising:

positioning a compressor system on a base supported by a support surface;

hanging at least one intercooler on a cantilevered arm extending from the base; wherein the hanging includes engagement of a hook portion of a bracket with a portion of the cantilevered arm;

fluidly connecting at least one intercooler to the compressor system;

permitting sliding movement of the bracket along the cantilevered arm in response to moving forces acting on the at least one intercooler.

18. The method of claim 17, wherein the moving forces includes movement caused by thermal expansion of the at least one intercooler and/or other portions of the compressor system.

19. The method of claim 17, wherein the compressor system includes a centrifugal compressor, a primary power source, and fluid conduits connecting the at least one intercooler with a portion of the compressor system.

20. The method of claim 17, further comprising:

cooling at least a portion of the air compressed by the compressor system with the intercooler.

21. The method of claim 17, further comprising:

moving the compressor system and the at least one intercooler from one location to a different location without disconnecting the at least one intercooler from the compressor system.

* * * * *